US009750286B1

(12) United States Patent
Wold et al.

(10) Patent No.: US 9,750,286 B1
(45) Date of Patent: Sep. 5, 2017

(54) PREFORMED POCKET SQUARE APPARATUS WITH INTERCHANGEABLE DECORATIVE TOPS

(71) Applicants: Travis John Wold, Jacksonville, FL (US); Joseph Clinton Jensen, Lawndale, NC (US)

(72) Inventors: Travis John Wold, Jacksonville, FL (US); Joseph Clinton Jensen, Lawndale, NC (US)

( * ) Notice: Subject to any disclaimer, the term of this patent is extended or adjusted under 35 U.S.C. 154(b) by 21 days.

(21) Appl. No.: 15/041,031

(22) Filed: Feb. 11, 2016

(51) Int. Cl.
*A41D 27/20* (2006.01)
*A41B 15/00* (2006.01)

(52) U.S. Cl.
CPC ..... *A41B 15/00* (2013.01); *A41D 27/20* (2013.01)

(58) Field of Classification Search
CPC ..... A41B 15/02; A41B 3/08; A41D 27/20; A44B 99/00
USPC ..... 2/279, 249, 250, 251, 252; 24/536, 564
See application file for complete search history.

(56) References Cited

U.S. PATENT DOCUMENTS 3,514,790 A 6/1970 Harvey
3,786,520 A 1/1974 Harmon
4,417,370 A 11/1983 Lewis
4,897,900 A * 2/1990 Baggett ..... A41B 15/02 24/3.5
5,253,370 A 10/1993 Mead
7,107,627 B2 9/2006 Holland
7,854,021 B2 * 12/2010 Compton ..... G09F 21/02 2/243.1
9,089,170 B2 7/2015 Muratore
2007/0113323 A1 5/2007 Groves
2016/0120234 A1 * 5/2016 Cobb ..... A41B 15/02 2/250

OTHER PUBLICATIONS https://www.jcrew.com/mens_feature/ThePocketDial_sm.jsp as of Jan. 17, 2017.

* cited by examiner

*Primary Examiner* — Tejash Patel

(57) ABSTRACT

A pocket square assembly for a garment enclosure includes a top assembly having a main body portion, a top portion, and a mounting plate internal to the main body portion; and a base assembly adapted to be precisely received within the garment enclosure, the base assembly comprising a slide holder and a mounting slider, wherein the mounting slider cooperates with the slide holder to provide infinite adjustability of the base assembly and defines a cavity for a base mounting component, and wherein the base mounting component detachably mates with the mounting plate of the top assembly such that the top portion extends a predetermined distance out of the garment enclosure.

5 Claims, 6 Drawing Sheets

PREFORMED POCKET SQUARE APPARATUS WITH INTERCHANGEABLE DECORATIVE TOPS

RELATED APPLICATIONS

This Application claims the benefit of U.S. Provisional Application No. 62/114,935, filed Feb. 11, 2015, and 62/171,261, filed Jun. 5, 2015, each of which is incorporated by reference herein in their entirety.

BACKGROUND

The present invention relates to a method for consistent, quick, and easy display and interchange of pocket squares/handkerchiefs from the pocket of a suit, jacket, dress, or any other clothing apparel to create a stylish appearance.

The current practice of wearing a pocket square requires folding a square, or otherwise, shaped cloth and inserting it into the breast pocket of a man's suit coat. Pocket squares are also displayed from jackets, dresses, or any other pocket of a garment. As used herein, the term "pocket" will generally refer to any enclosure used to display a handkerchief from an article of clothing. The pocket square should visibly protrude from the pocket for all to see. The experience of wearing a pocket square should provide the wearer with increased confidence and style.

Several fundamental problems exist with conventional folded pocket squares:

The first problem requires the user to know how to properly fold the square and properly insert it into the pocket. This step is time consuming and frustrating because the neatly folded square may not fit the first time (too big or small) and have to be re-folded or the fold gets disrupted during insertion, which requires refolding. Additionally, an improperly folded square could create an unsightly bulge in the pocket of the garment from which it is displayed.

The second problem is once a pocket square is properly folded and placed into a suit pocket, it will typically move throughout the day which results in it not being visible or, worse, it becomes disheveled which can impact the confidence of the wearer. Also when the user desires to quickly swap out different colors and styles to go with the wearer's outfit, each change of the pocket square requires another folding process.

Various methods have previously been proposed to solve the problems associated with conventional pocket squares. The most common solution features a device that cradles a pre-folded pocket square or pre-sewn, pre-folded pocket square portion into an envelope or pouch that can be inserted into the pocket. A problem with current cradle-type solutions that hold a full size square is that inserting the pocket square into the pocket can be difficult and time consuming and continues to require the user to fold the square or remove the cradling or support device from the pocket in order to interchange the displayed pocket square. Solutions that cradle pre-folded pocket squares require careful and skillful folding to achieve the desired look and can also leave an unsightly bulge in the users pocket and require the user to fully insert the cradled pocket square into the pocket for proper display.

Other solutions feature pre-sewn, pre-folded pocket squares permanently or temporarily fixed onto, within, or over a mounting device made for easy insertion into the pocket. The mounting devices may enable the proper display of the pocket square but require the user to fully insert the pocket square device into the pocket, which can be time consuming and frustrating as not all pockets are of equal depth. Also because pockets have varying depths, some solutions contain adjustment features for enabling the proper height of the pocket square. However, if the user desires to switch pocket squares between garments he/she may need to readjust the depth of these devices. Also many of these solutions cannot be laundered as they frequently contain fibrous materials. Additionally, when the aforementioned solutions are viewed outside of the pocket it is obvious to others that the pocket square is of the non-conventional kind as most are pre-folded and/or pre-sewn and have obvious features used for insertion or centering in the pocket.

Despite all prior attempts, there remains a need in the art for a solution with an ability to quickly and easily swap out the displayed pocket square while using a common and fashionable base that affords height adjustments for various sized pockets. Further, there exists a need in the art for a quickly interchangeable pocket square system with non-obvious attachment means so as to have a more conventional look when the pocket square is viewed outside of the pocket. There also exists a need in the art for an attractive and useful base component that allows for infinite adjustment and space for discreet storage of other items.

SUMMARY

The present invention is a preformed pocket square system that enables precise placement of a pocket square into the top of a pocket with minimal manipulation by the user while maintaining its folded shape and appearance throughout the day. The pocket square system is comprised of at least two primary assemblies: a) a decorative top assembly and b) a base assembly. The base assembly is a fashionable adjustable device intended for insertion into a suitable pocket, for example a breast pocket, of a coat or any other garment. Features of the base assembly provide for a desired amount of reveal for the decorative top assembly. The base assembly is not intended to be visible outside of the pocket when worn but is aesthetic when viewed outside of the users pocket. The base assembly features a mounting slider that is intended to temporarily mate to the decorative top assembly. The decorative top assembly detachably mates to the base assembly such that the decorative top assembly may be situated with a bottom portion minimally inserted into the pocket and the remaining upper portion visible outside of the pocket for intended viewing.

In accordance with aspects of the present disclosure, the base assembly may remain in the breast pocket indefinitely if the user desires, as it is not visible and would not hinder the wearer of the jacket/suit coat. Furthermore, the base assembly is slim fitting in the pocket, eliminating any unsightly bulge in the pocket. The width of said base assembly may be fixed. In accordance with yet other aspects of the present disclosure, the base assembly may be adjustable.

The base assembly comprises at least two components which cooperate to form an infinitely adjustable base from which the decorative top assembly can be detachably mounted for aesthetic display. The base assembly is formed with an aesthetic slide holder that is typically leather but can be made from a variety of materials, including but not limited to artificial leather, wood, cloth, plastic, or any other suitable material that is able to be cut and fastened together to form a pouch for holding the second component of the base assembly. The second component of the base assembly is referred to as the mounting slider and contains an ergonomic grasping feature for quick and easy adjustment of the mounting slider. The grasping feature may also contain a cavity near the top for mounting or housing a magnet or metallic component that facilitates a magnetic connection to the decorative top assembly. The mounting slider is permanently retained in the bottom assembly with one or more fasteners mounted in the slide holder that prevents complete separation of the two components. The fasteners interact with through slots in the mounting slider so as to allow for infinite adjustment to a predetermined position and provide ample friction to resist movement throughout the day. The slide holder of the base assembly could be made to define any shape but is typically square with radius edges to enable quick and easy insertion into the pocket of the user. The base assembly also provides ample space for logos, branding, or personalization if so desired by the user. The base assembly may also contain horizontal slots on one or both faces of the slide holder forming storage for which to discretely store items such as money, credit cards, or other articles the user wishes to carry.

The decorative top assembly of the system may be manufactured in a plurality of styles and designs. In accordance with aspects of the present disclosure, each top assembly is comprised of at least two fundamental components, an internal mounting plate and a pre-sewn cloth portion intended to look like a folded pocket square. The internal mounting plate provides a form for which the pocket square can be shaped and sewn upon as well as a location for a magnet or metallic mounting component to reside that supports the temporary connection of the pocket square to the base assembly. The internal mounting plate is intended to be permanently secured within the pre-sewn cloth and not removable by the user. The magnets or metallic components therein are not visible to the user and the magnetic attraction is strong enough to firmly secure the decorative top assembly to the bottom assembly through the pocket square cloth.

In accordance with other aspects of the present disclosure, the base assembly functionality may be permanently incorporated into the pocket of a suit, jacket, dress or any other garment by sewing a magnet or metallic component into a pocket cavity at time of garment manufacture. The magnet or metallic mounting component shall then couple to the decorative top assembly near the top edge of the pocket so as to allow a proper amount of reveal for the decorative top assembly from the pocket. The magnet or metallic cavity inside the garment pocket shall mount as a foldable flap internal to the pocket and, when not engaged, rotate out of the way when other uses for the pocket are needed.

BRIEF DESCRIPTION OF DRAWINGS

The invention will be more fully understood and further advantages will become apparent when reference is had to the following detailed description and the accompanying drawings, in which.

DETAILED DESCRIPTION

Figure 1:
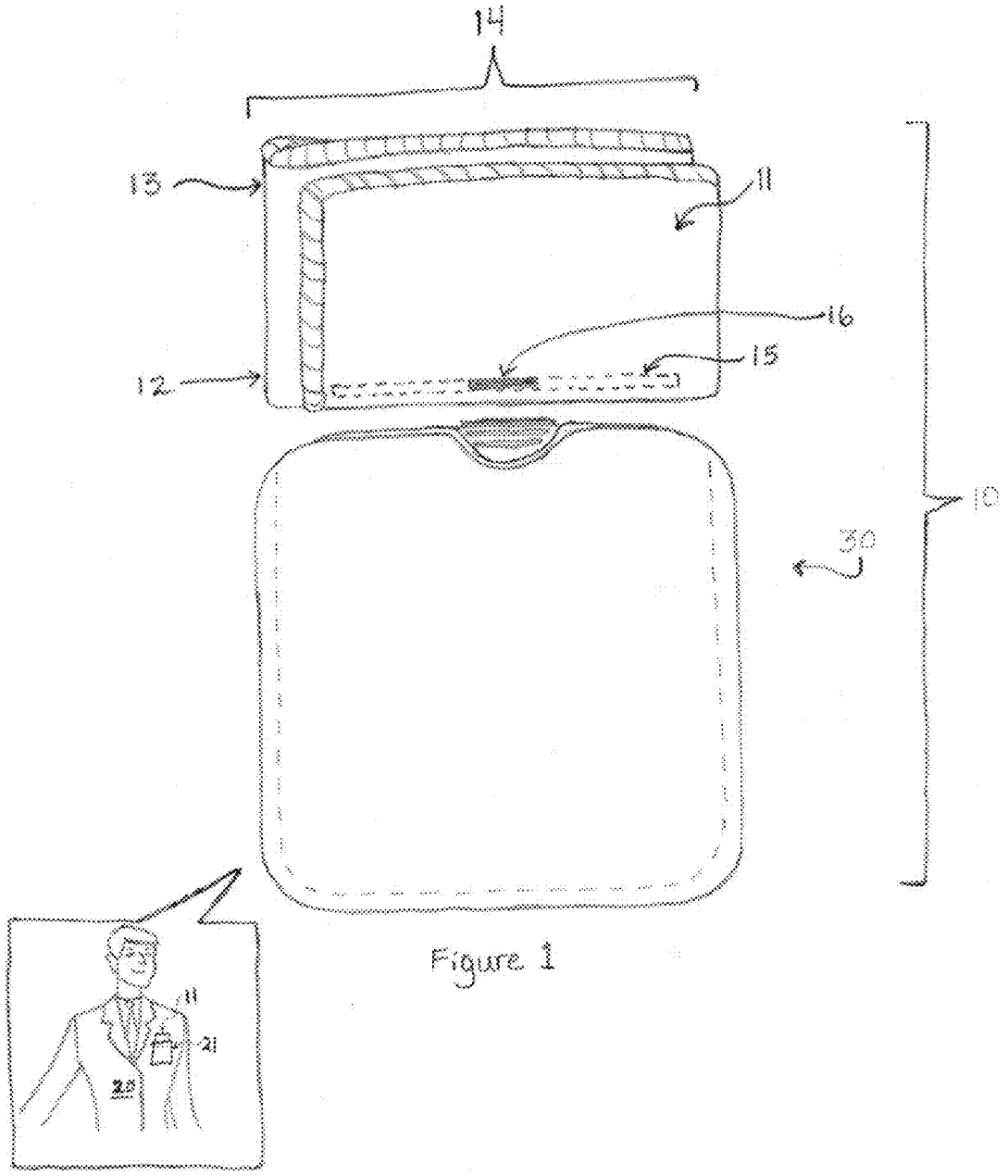
FIG. 1. illustrates a preformed pocket square apparatus with interchangeable decorative tops, in accordance with aspects of the present disclosure.

The present disclosure provides a pocket square apparatus that quickly and easily displays a pocket square in a suit, vest, or jacket pocket, thereby obviating many of the steps currently required to maintain proper placement of pocket squares. Quick and easy display is achieved by way of a decorative top assembly that is mounted in cooperation with a base assembly within the pocket of the suit jacket or clothing apparel. Generally stated, the preformed pocket square apparatus with interchangeable decorative tops is constructed to include a decorative top assembly and a base assembly that cooperate to securely retain the decorative top within a breast pocket. The decorative top assembly is generally constructed having a main body portion and a top portion. At least a segment of the top portion is appointed to protrude from the pocket, while at least a segment of the body portion is appointed to be placed and precisely received within the pocket of the article of clothing. The base assembly is adapted to secure the decorative top assembly force said assembly to remain upright, secured and aligned within the pocket with the desired amount of protrusion of said assembly from the crest of the pocket.

The subject preformed pocket square apparatus with interchangeable decorative tops broadly comprises: (i) a decorative top assembly having a main body portion and a top portion wherein the main body portion is appointed to be placed and precisely received within a pocket of an article of clothing while at least a portion of the top portion is appointed to protrude from the pocket; (ii) a base assembly that is adapted to be precisely received within the pocket of the suit jacket and associates with the decorative top assembly to force the pre-folded pocket square member to remain upright, secured and aligned within the pocket.

The decorative top assembly is formed in a plethora of shapes and is generally preformed in a variety of pocket square folding configurations. These configurations of the pre-folded pocket square may include, for non-limiting example: (1) "The Presidential", wherein the pocket square is pre-folded at right angles; (2) "The TV Fold", wherein the pocket square is pre-folded diagonally; (3) "The One-point Fold", wherein the pocket square is pre-folded diagonally with the point protruding from the pocket; (4) "The Two-point Fold", wherein the pocket square is pre-folded off-center so the two points do not completely overlap; (5) "The Three-point Fold", wherein the pocket square is first folded into a triangle, then the corners are folded up and across to make a pre-folded configuration having three points; and (6) "The Four-point Fold", wherein the pocket square is pre-folded via an off-center version of the Three-point Fold; and 7) "The Puff", where-in the pocket square is grasped from the center to provide a billowy appearance protruding from the pocket. While the pre-folded pocket square may be prefabricated or configured in any of these pre-formed configurations, other configurations are anticipated and any pre-folded configuration can be utilized without departing from the scope of the subject disclosure. In so pre-forming the pocket square, the body portion is preferable formed generally as a parallelogram, rectangle, triangle, etc., depending on the fold configuration style of the handkerchief/pocket square. The top portion includes a decorative folded configuration.

FIG. 1 illustrates a first embodiment of the preformed pocket square apparatus with interchangeable decorative tops shown generally at 10. The preformed pocket square apparatus with interchangeable decorative tops is appointed to be placed within a garment enclosure, such as pocket 21 of a suit jacket 20 lapel (or any suitable clothing apparel having a lapel pocket appointed to receive a pocket square therein). Herein clothing apparel is specified as a suit jacket 20; however any type of clothing apparel having a breast/lapel pocket for receiving a pocket square is contemplated for use in accordance with aspects of the present disclosure.

A decorative top assembly 11 is provided. Decorative top assembly 11 generally comprises a main body portion 12 and a top portion 13. The dimensions of decorative top assembly 11 vary based on the dimensions of the intended pocket 21 and the decorative fold configuration generally shown as 14 but will have a length of one to four inches in the x axis; a length one to six inches in the y axis, and a length not to exceed 2 inches in the z axis. Body portion 12 is appointed to be placed and received within pocket 21 of suit jacket 20 while at least a portion of top portion 13 is appointed to protrude from pocket 21 and be visible for aesthetic appeal. Body portion 12 is preferably formed generally as a parallelogram, rectangle, triangle, or the like, depending on the fold configuration style of the handkerchief/pocket square. Top portion 13 includes a decorative folded configuration generally shown as 14, and commonly known as the "The Presidential" fold. Herein the decorative folded configuration 14 is shown. However, it will be understood that there are a wide variety of ways to fold a pocket square/handkerchief; accordingly, the pre-fold configuration can be arranged in an array of different formations. Some fold types or formations of the pre-folded pocket square member 11 may include, for non-limiting examples: 1) "The Presidential", wherein the pocket square is pre-folded at right angles; 2) "The TV Fold", wherein the pocket square is pre-folded diagonally and the point represents the body portion 12 adapted to go inside the pocket 21; 3) "The One-point Fold", wherein the pocket square is pre-folded diagonally with the point showing representing the top portion 13 protruding from the pocket; 4) "The Two-point Fold", wherein the pocket square is pre-folded off-center so the two points do not completely overlap; 5) "The Three-point Fold", wherein the pocket square is first folded into a triangle, then the corners are folded up and across to make a pre-folded configuration having three points via folded edge; 6) "The Four-point Fold", wherein the pocket square is per-folded via an off-center version of the Three-point Fold and 7) "The Puff", where-in the pocket square is grasped from the center to provide a billowy appearance protruding from the pocket. While the preformed pocket square apparatus may be prefabricated or configured in any of these pre-formed configurations, other configurations are anticipated and any pre-folded configuration can be utilized without departing from the scope of the present invention.

Decorative top assembly 11 contains a mounting plate 15 internal to the body portion 12 of said top assembly that is not visible and non-obvious when viewing decorative top assembly 11. Mounting plate 15 is preferably made of plastic but could be made of wood, metal, or any other rigid material and contains a magnetic mounting component 16 therein which serves to create a magnetic attachment to base assembly 30 detailed in FIG. 2. Magnetic mounting component 16 may be composed of magnets or alternatively, may be composed of similarly shaped metallic components intended to mate to magnets. Magnetic mounting component 16 provides a temporary magnetic attachment to base assembly 30 and performs equally well when said base assembly is situated inside or outside of pocket 21. Similarly, magnetic mounting component 16 creates effortless self-centering alignment about the x and z axis with base assembly 30 about the x and z axis when coupled to said base assembly.

Figure 2:
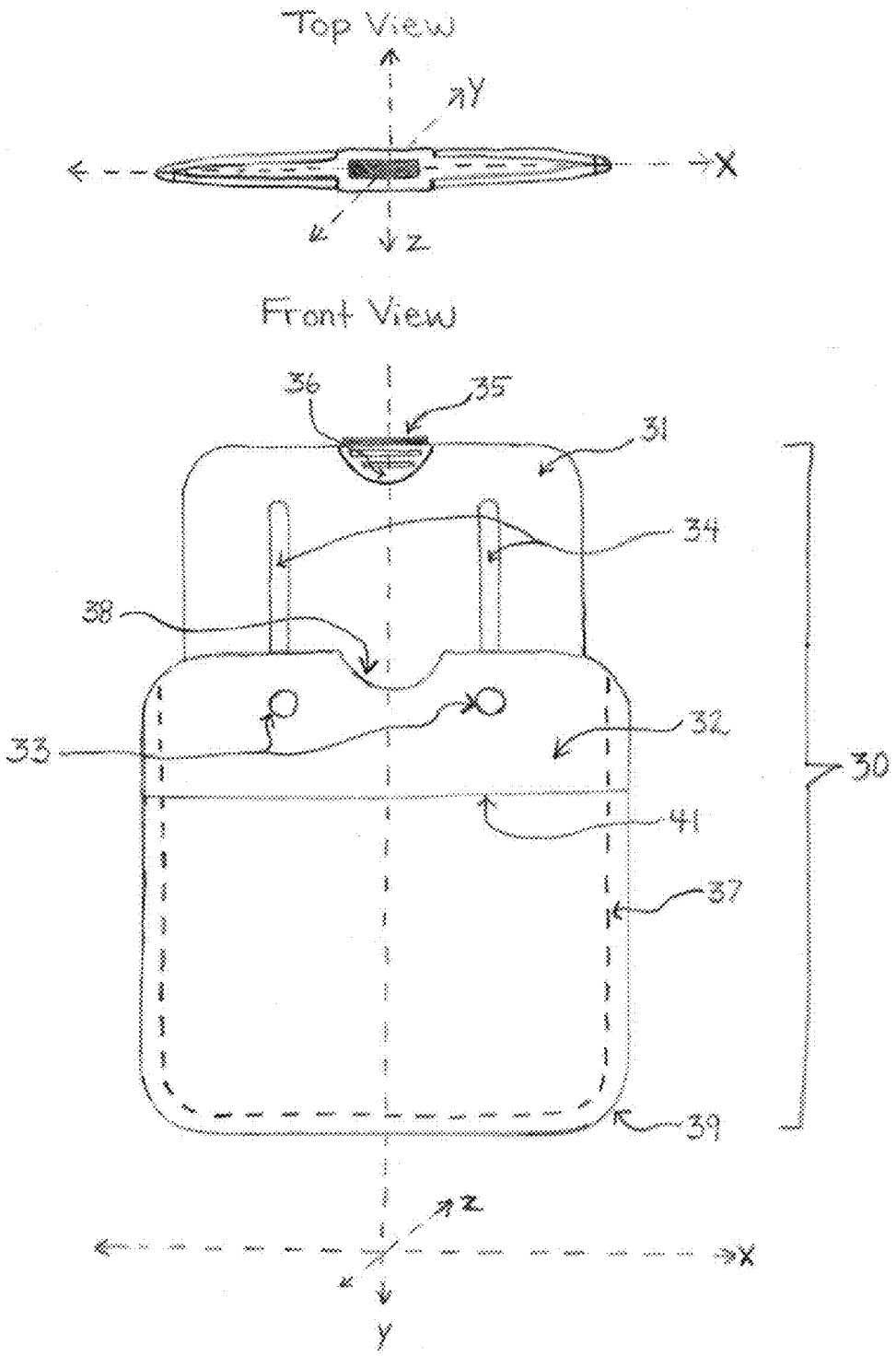
FIG. 2. illustrates the preformed pocket square apparatus with interchangeable decorative tops of FIG. 1 and shows an adjustment mechanism of the bottom assembly, in accordance with aspects of the present disclosure.

FIG. 2 further illustrates the frontal view of base assembly 30 of the present disclosure of preformed pocket square apparatus with interchangeable decorative tops. Base assembly 30 is comprised of a rigid mounting slider 31 which is infinitely adjustable about the y axis and is retained within aesthetic slide holder 32 through the use of one or more fasteners 33 which interact with one or more openings 34 within mounting slider 31. The maximum dimensions of base assembly 30 will vary based on the size of pocket 21 but are generally less than five inches in length about the x axis; less than five inches in length about the y axis when rigid mounting slider 31 is in a retracted position, and less than one inch about the z axis. Mounting slider 31 is generally made from moldable or machine formed materials such as plastic, wood, or other rigid materials. Mounting slider 31 is extendable about they axis to a length not to exceed they axis dimension of base assembly 30.

Mounting slider 31 contains one or more magnetic mounting components 35 housed within ergonomic grasping feature 36. The maximum dimensions of ergonomic grasping feature 36 are generally less than the maximum dimensions of base assembly 30 along the x and y axis and generally match, but could exceed or be exceeded by the z axis dimension of base assembly 30 to provide a streamlined look. Ergonomic grasping feature 36 may also contain features for increasing friction when grasped by the hand for the purpose of extending mounting slider 31 about the y axis. Magnetic mounting component(s) 35 may be composed of magnets or alternatively, magnetic mounting component(s) 35 may be composed of similarly shaped metallic components intended to mate to magnets. Aesthetic slide holder 32 is provided and is generally made form leather or cloth but could be made from any formable material. The maximum dimensions of aesthetic slide holder 32 shall not exceed the maximum dimensions of base assembly 30 and said aesthetic slide holder may contains stitchings 37 for the purpose of creating a pocket for housing mounting slider 31, stitchings 37 are preferably made with thread but could alternatively be substituted with glue, ultrasonic welding, mechanical rivets or any other fastening method suitable for permanent fastening of materials. Furthermore aesthetic slide holder 32 may contain one or more reliefs 38 that allow ergonomic grasping feature 36 of mounting slider 31 to be fully inserted into aesthetic slide holder 32 to provide a streamlined look. Aesthetic slide holder may also contain one or more radius edges 39 to facilitate easier entry into the suit pocket 21. Aesthetic slide holder 32 may also contain one or more integrated pockets 41 preferably oriented horizontally but could be oriented vertically or diagonally about the surface of aesthetic slide holder 32 for the purpose of discreetly storing money, credit cards, or other items for the user.

Figure 2B:
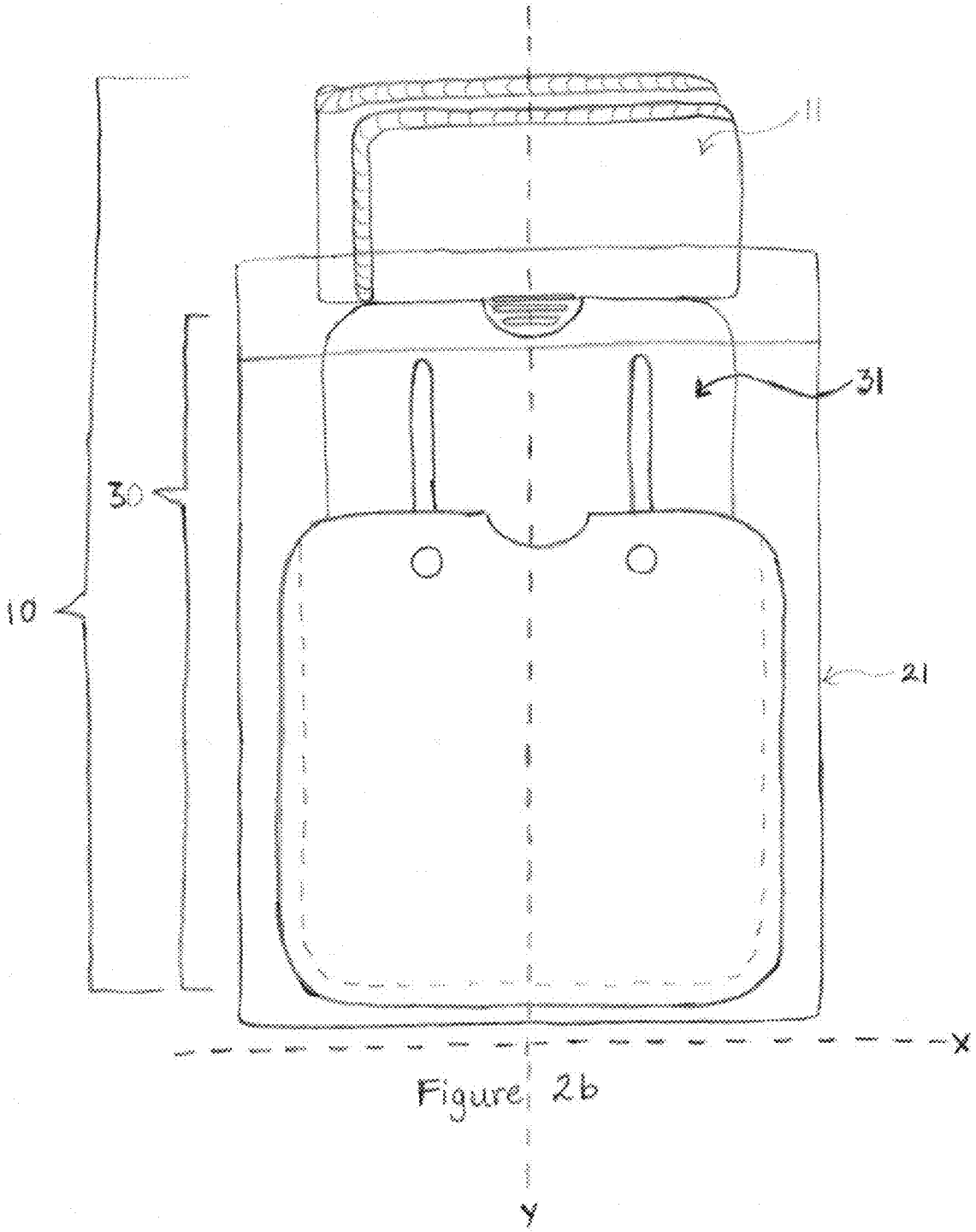
FIG. 2*b* illustrates the preformed pocket square apparatus of FIG. 1 in a particular mode of use, wherein a decorative top assembly is being coupled to the base assembly pre-installed in a pocket, in accordance with aspects of the present disclosure.
Figure 2A:
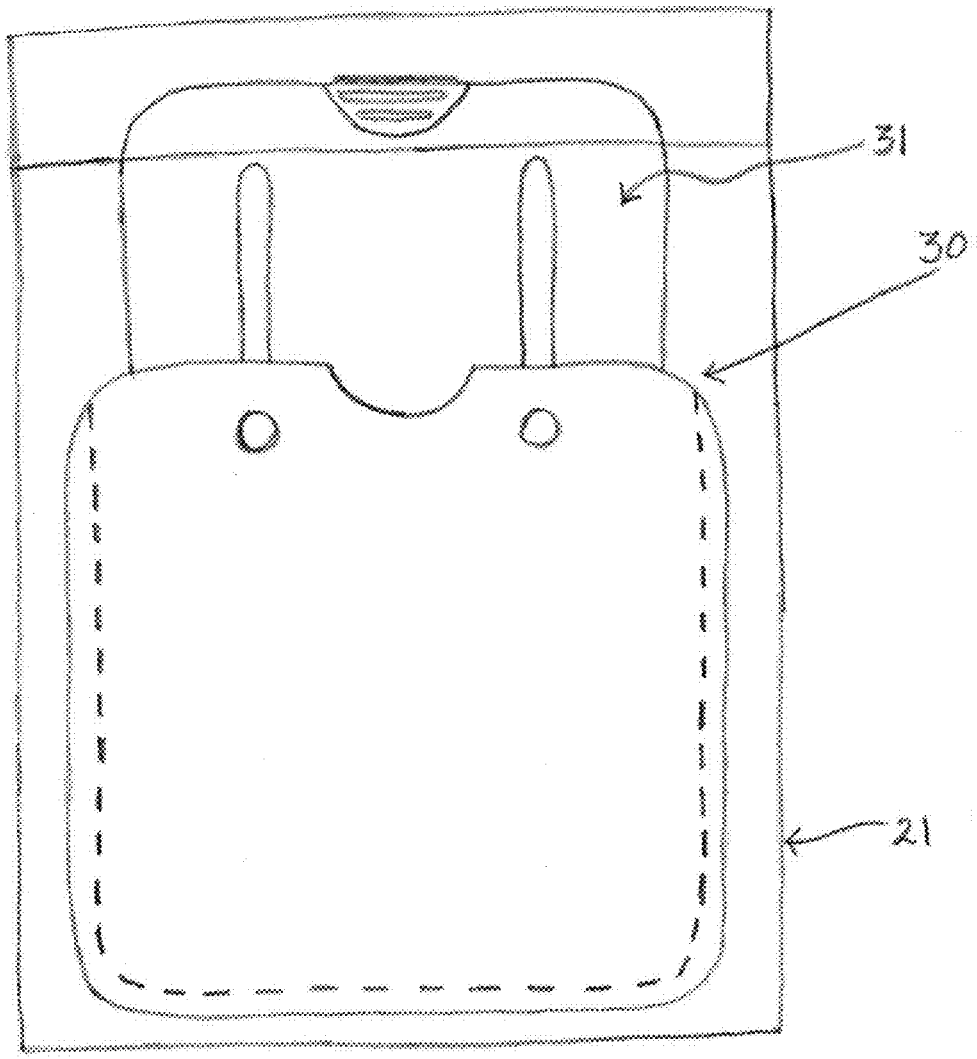
FIG. 2*a* illustrates the preformed pocket square apparatus of FIG. 1 in a particular mode of use, wherein the pocket square base assembly is inserted within a pocket, in accordance with aspects of the present disclosure.

FIG. 2*a* further illustrates the base assembly 30 of the present disclosure preformed pocket square apparatus with interchangeable decorative tops shown permanently or temporarily housed in suit pocket 21 with mounting slider 31 extended to a suitable position for accepting decorative top assembly 11 shown in FIG. 1.

FIG. 2*b* further illustrates the present disclosure of the preformed pocket square apparatus with interchangeable decorative tops shown generally at 10 housed in suit pocket 21.

The user can adjust the height of mounting slider 31 about they axis to provide the desired protrusion of decorative top assembly 11 above the crest of suit pocket 21. If the user desires to rapidly and easily exchange decorative top assembly 11 with a different decorative top assembly 11 only a small force is required for detachment from mounting slider 31. Base assembly 30 need not be removed from suit pocket 21 to facilitate changing of decorative top assembly 11.

Figure 3A:
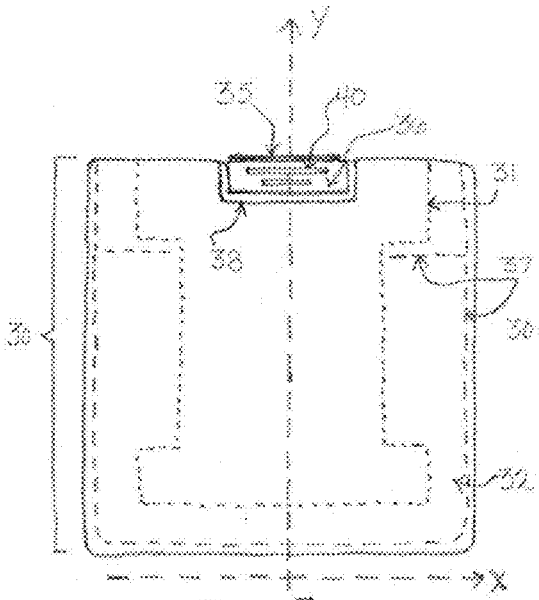
FIG. 3*a*-3*d* illustrates various aspects of a coupling mechanism incorporated into the bottom assembly of the subject preformed pocket square apparatus with interchangeable decorative tops of FIG. 1, in accordance with aspects of the present disclosure.
Figure 3B:
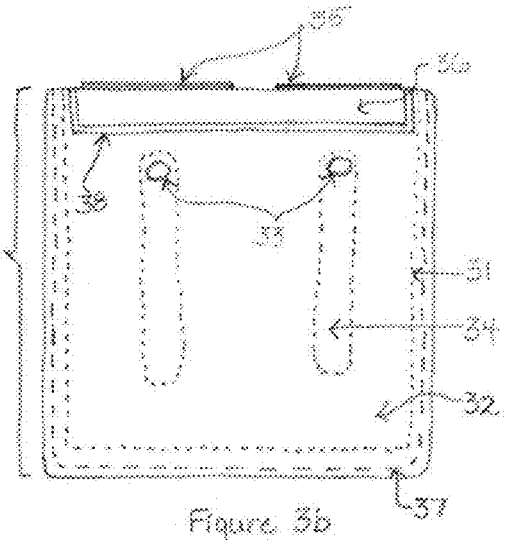
Figure 3C:
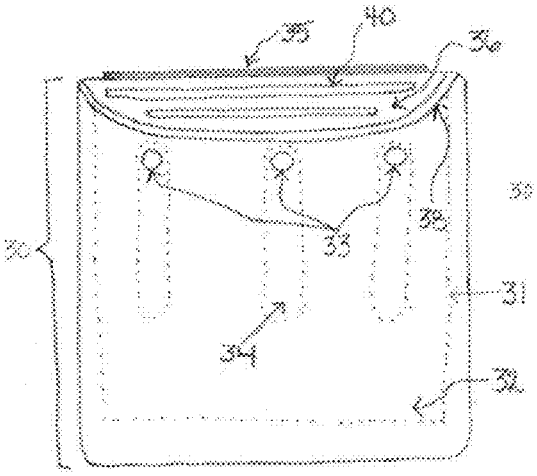
Figure 3D:
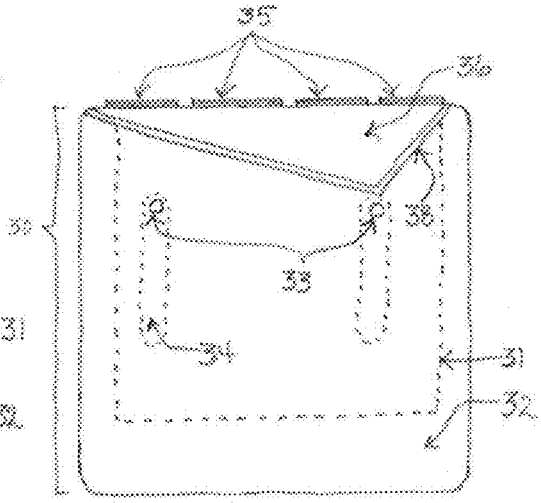

FIGS. 3*a*-3*d* illustrate non-limiting views of alternative aspects of the present disclosure of the base assembly 30 shown in FIGS. 1, 2, 2*a*, and 2*b*. For those skilled in the art, it should be generally understood that base assembly 30 is preferably made in the shape of a parallelogram but could be made of a variety of shapes like semi-circles, triangles, or any other polygon suitable for placement into a suit pocket. Ergonomic grasping feature 36 may or may not be a required feature for proper operation of base assembly 30. In the absence of ergonomic grasping feature 36, magnetic mounting component 35 shall be incorporated into mounting slider 31. In accordance with aspects of the present disclosure ergonomic grasping feature 36 shall may contain a variety magnetic mounting components 35 integrated therein and could be made with a variety of profiles supported by mounting slider 31 including but not limited to those shown in FIGS. 3*a*-3*d*. Ergonomic grasping feature 36 may or may not contain friction-increasing slots 40 as shown in FIGS. 3*a* and 3*c*. Aesthetic slide holder 32 may contain a variety of reliefs 38 built therein to eliminate the potential of spatial interference between aesthetic grasping feature 36 and aesthetic slide holder 32. Aesthetic slide holder 32 may contain stitchings 37 or similar fastening methods oriented about aesthetic slide holder 32 in a precise way so as to restrict the y-axis extension of mounting slider 31 by interfering with one or more surfaces of mounting slider 31 thereby eliminating the need for fasteners 33 show by way of non-limiting example in FIG. 3*a*. As such, aesthetic slide holder 32 may contain zero or more fasteners 33 for limiting the y axis travel of mounting slider 31 as depicted in FIG. 2*b*.

Figure 4:
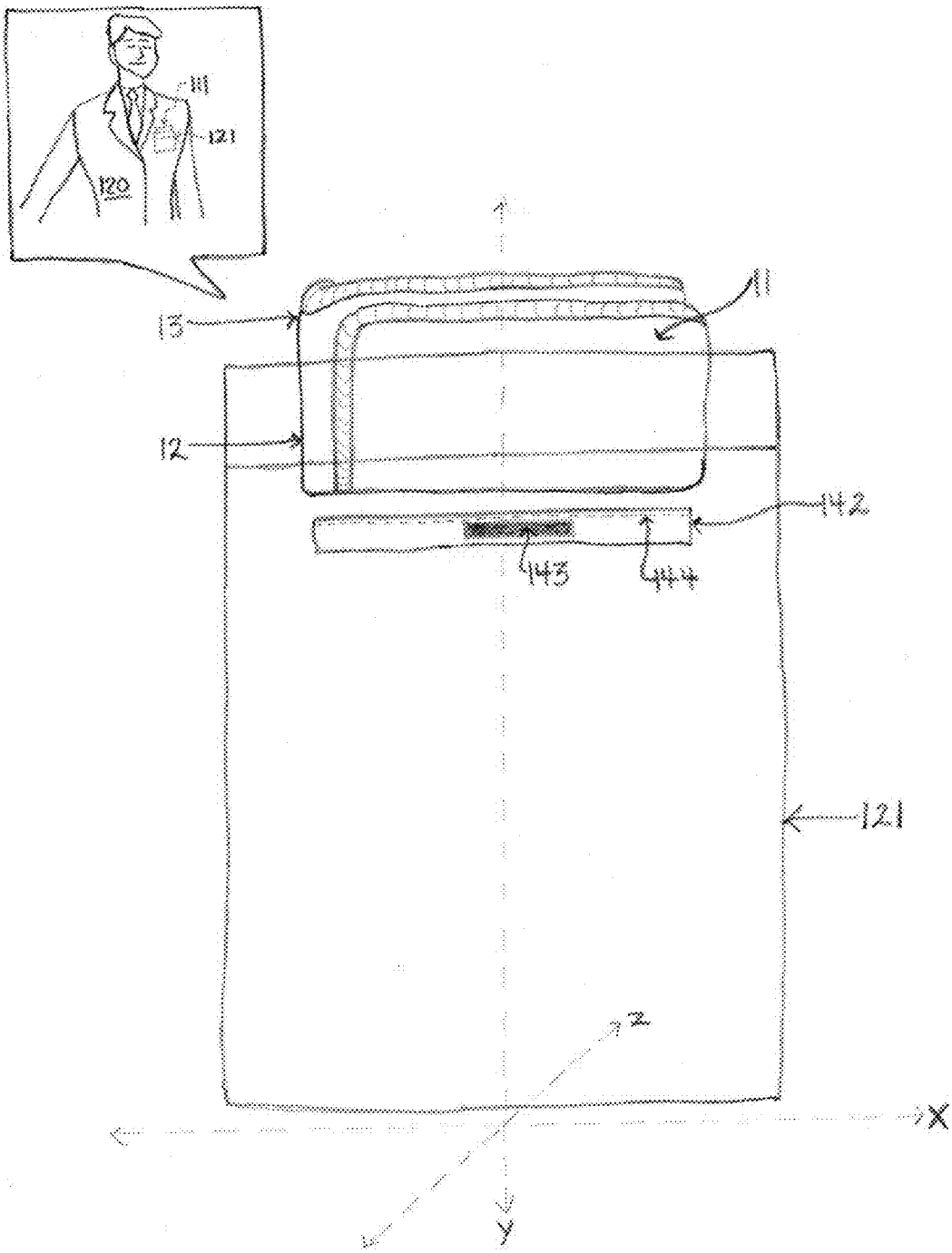
FIG. 4 illustrates aspects of another preformed pocket square apparatus with interchangeable decorative tops, wherein the decorative top assembly is inserted into the pocket of a garment, in accordance with aspects of the present disclosure.

FIG. 4 illustrates another aspect of the present disclosure preformed pocket square apparatus with interchangeable decorative tops; wherein decorative top assembly 11 as shown in FIG. 1 contains a top portion 13 and a bottom portion 12 and at least a portion of decorative top assembly 11 is appointed to be displayed from pocket 121 of suit jacket 120 lapel (or any clothing having a lapel pocket appointed to receive a pocket square therein). Bottom portion 12 is inserted into pocket 121 which contains a magnetic mating flap 142 integrated into an interior wall of pocket 121 so that it is non-obvious to the user of suit jacket 120. Magnetic mating flap 142 contains a magnetic mounting plate 143 therein which serves to create a magnetic attachment to bottom portion 12 of decorative top assembly 11. Magnetic mounting plate 143 may be composed of magnets or alternatively, magnetic mounting plate 143 may be composed of similarly shaped metallic components intended to mate to magnets. Magnetic mating flap 142 shall be fastened into the interior of pocket 121 with a row of stitching 144 or alternatively glue or tape or any other fastening method so that magnetic mating flap 142 is able to fold upward about the z plane. When bottom portion 12 of decorative top assembly 11 is placed into pocket 121, magnetic mating flap 142 shall fold upward in the z plane and shall temporarily attach to bottom portion 12 of decorative top assembly 11 by magnetic force so that decorative top assembly 11 is properly displayed from pocket 121. When the user does not desire to display decorative top 11 from pocket 121 magnetic mating flap 142 folds down about the z plane to allow for alternative uses of pocket 121 which could include the placement of a conventional pocket square.

The decorative top assembly comes in an array of colors, designs, fabrics and pre-folded configurations so that a user can quickly and easily change out the style/color of the decorative top assembly and replace the newly selected decorative top assembly within the pocket of the jacket. Decorative top assemblies may be sold alone or in combination with the base assembly, and/or in combination with a matching tie and/or shirt or other apparel.

Having thus described the invention in rather full detail, it will be understood that such detail need not be strictly adhered to, but that additional changes and modifications may suggest themselves to one skilled in the art, all falling within the scope of the invention as defined by the subjoined claims.

It will be apparent to those skilled in the art that various modifications and variations can be made without departing from the spirit or scope of the disclosed embodiments. Since modifications, combinations, sub-combinations and variations of the disclosed embodiments incorporating the spirit and substance of the embodiments may occur to persons skilled in the art, the disclosed embodiments should be construed to include everything within the scope of the appended claims and their equivalents. As will be understood by those of ordinary skill in the art, features and attributes associated with embodiments shown in one of the Figures or described in the text relating to one of the embodiments may well be applied to other embodiments shown in another of the Figures and/or described elsewhere in the text.

What is claimed is:

1. A pocket square assembly for a garment enclosure, the pocket square assembly comprising:

a top assembly having a main body portion, a top portion, and a mounting plate internal to the main body portion; and a base assembly adapted to be received within the garment enclosure, the base assembly comprising a slide holder and a mounting slider, wherein the mounting slider cooperates with the slide holder to provide adjustability of the base assembly and defines a cavity for a base mounting component, wherein the base mounting component detachably mates with the mounting plate of the top assembly such that the top portion extends a predetermined distance out of the garment enclosure.

2. The pocket square assembly of claim 1, wherein the mounting slider further comprises an ergonomic grasping feature.

3. The pocket square assembly of claim 1, wherein the slide holder is formed from a leather material.

4. The pocket square assembly of claim 1, wherein the slide holder comprises one or more pockets defining an integrated storage capacity.

5. The pocket square assembly of claim 2, wherein the slide holder comprises one or more reliefs that allow the grasping feature to be fully inserted into the slide holder.

* * * * *